US005807082A

United States Patent [19]

Skinner et al.

[11] Patent Number: 5,807,082

[45] Date of Patent: Sep. 15, 1998

[54] AUTOMATIC DOWNHOLE PUMP ASSEMBLY AND METHOD FOR OPERATING THE SAME

[75] Inventors: Neal G. Skinner, Lewisville; Paul D. Ringgenberg, Carrollton, both of Tex.

[73] Assignee: Halliburton Energy Services, Inc., Dallas, Tex.

[21] Appl. No.: 657,265

[22] Filed: Jun. 3, 1996

[51] Int. Cl.[6] ..... F04B 17/00; E21B 43/00

[52] U.S. Cl. ..... 417/375; 417/401; 166/264

[58] Field of Search ..... 417/392, 375, 417/399, 401; 166/100, 101, 104, 105, 110, 148, 151, 153, 321, 332.2, 264

[56] References Cited

U.S. PATENT DOCUMENTS

| | | | |
|---|---|---|---|
| 2,261,752 | 11/1941 | Buckner | 417/401 X |
| 3,020,848 | 2/1962 | Green | 417/392 X |
| 3,503,445 | 3/1970 | Cochrum et al. | 166/151 X |
| 4,084,923 | 4/1978 | Roeder | 417/393 |
| 4,137,975 | 2/1979 | Pennock | 175/65 |
| 4,313,495 | 2/1982 | Brandell | 166/53 |
| 4,492,537 | 1/1985 | Awerkamp | 417/404 |
| 4,544,335 | 10/1985 | Roeder | 417/401 |
| 4,714,116 | 12/1987 | Brunner | 166/321 |
| 5,104,296 | 4/1992 | Roeder | 417/403 |
| 5,207,726 | 5/1993 | Rathweg | 417/393 |
| 5,494,102 | 2/1996 | Schulte | 166/105.6 |
| 5,651,666 | 7/1997 | Martin | 417/375 |

FOREIGN PATENT DOCUMENTS

| | | | |
|---|---|---|---|
| 0697501 | 2/1996 | European Pat. Off. | E21B 49/00 |
| 0781893 | 7/1997 | European Pat. Off. | E21B 33/124 |

OTHER PUBLICATIONS

Halliburton Company pamphlet entitled "New Halliburton Continuous Retrievable Sampler" as published in Nov., 1959, 4 pgs.

Halliburton Company Technical Data Sheet for Continuous Retrievable Sampler as published Jul., 1959, 2 pgs.

Chisholm, Pat, "New Test Tool Samples Several Zones In One Trip", Reprinted from World Oil, May, 1960, Distributed by Halliburton Oil Well Cementing Company, May, 1960, 4 pgs.

*Primary Examiner*—Ismael Izaguirre
*Attorney, Agent, or Firm*—William M. Imwalle; Paul I. Herman; Lawrence R. Youst

[57] ABSTRACT

An automatic downhole pump assembly comprising a housing, a sleeve slidably disposed within the housing, a piston defining an interior volume, the piston slidably disposed within the sleeve and within the housing such that a fluid pressure within the interior volume causes the sleeve to oscillate relative to the housing and causes the piston to oscillate relative to the sleeve and the housing, and a pump which is operably associated with the piston such that fluid is pumped through the pump assembly as the piston oscillates relative to the housing.

42 Claims, 7 Drawing Sheets

AUTOMATIC DOWNHOLE PUMP ASSEMBLY AND METHOD FOR OPERATING THE SAME

TECHNICAL FIELD OF THE INVENTION

This invention relates, in general, to an automatic downhole pump assembly, and in particular to, a downhole pump having a power section and a pump section which is operably associated with the power section, so that the pump section is operated upon oscillatory motion of the power section.

BACKGROUND OF THE INVENTION

Without limiting the scope of the present invention, its background is described with reference to sampling a hydrocarbon formation during a drilling operation, as an example.

During the course of drilling an oil or gas well, one operation which is often performed is to lower a testing string into the well to test the production capabilities of hydrocarbon producing underground formations intersected by the well. Testing is typically accomplished by lowering a string of pipe, generally drill pipe or tubing, into the well with a packer attached to the string at its lower end. Once the test string is lowered to the desired final position, the packer is set to seal off the annulus between the test string and the wellbore or casing, and the underground formation is allowed to produce oil or gas through the test string.

It has been found, however, that more accurate and useful information can be obtained if testing occurs as soon as possible after penetration of the formation. As time passes after drilling, mud invasion and filter cake buildup may occur, both of which may adversely affect testing.

Mud invasion occurs when formation fluids are displaced by drilling mud or mud filtrate. When mud invasion occurs, it may become impossible to obtain a representative sample of formation fluids or at a minimum, the duration of the sampling period must be increased to first remove the drilling fluid and then obtain a representative sample of formation fluids.

Similarly, as drilling fluid enters the surface of the wellbore in a fluid permeable zone and leaves suspended solids on the wellbore surface, filter cake buildup occurs. The filter cake acts as a region of reduced permeability adjacent to the wellbore which reduces the accuracy of reservoir pressure measurements and affects the calculations for permeability and produceability of the formation.

Some prior art samplers have partially overcome these problems by making it possible to evaluate well formations encountered while drilling without the necessity of making two round trips for the installation and subsequent removal of conventional tools. These systems allow sampling at any time during the drilling operation while both the drill pipe and the hole remain full of fluid. These systems, not only have the advantage of minimizing mud invasion and filter cake buildup, but also, result in substantial savings in rig downtime and reduced rig operating costs.

These savings are accomplished by incorporating a packer as part of the drill string and recovering the formation fluids in a retrievable sample reservoir. A considerable saving of rig time is affected through the elimination of the round trips of the drill pipe and the reduced time period necessary for hole conditioning prior to the sampling operations.

These samplers, however, are limited in the sample volume which can be obtained due to the physical size of the sampler and the tensile strength of the wire line, slick line or sand line used in removal of the sampler. In addition, prior art samplers have been unable to sufficiently draw down formation pressure to clean up the zone and quickly obtain a representative sample of the formation fluids.

In order to draw down formation pressure in a drilling operation, a downhole pump must be utilized. Prior art downhole pumps, however, require complicated two part pumps which operate responsive to relative rotation between a first and a second pump part, require cycling of the tubing pressure to operate the pump or require pipe reciprocation or reciprocation of a sucker rod. All of these prior art downhole pumps suffer from various deficiencies relating to the complexity of their operating mechanisms, or from a necessity to rotate, reciprocate or cycle pressure into the pipe string in order to operate the pump.

Therefore, a need has arisen for an apparatus and a method for drawing down formation pressure to obtain a representative fluid sample during drilling that does not require rotation or reciprocation of the apparatus or cycling pressure into and out of the tubing string. A need has also arisen for a cost effective downhole tool for automatically pumping fluids into and out of a formation and for automatically pumping fluids into other downhole tools.

SUMMARY OF THE INVENTION

The present invention disclosed herein comprises an automatic downhole pump assembly having a power section and a pump section which is operably associated with the power section so that the pump section is operated upon oscillatory motion of the power section after application of a fluid pressure to the power section.

In one embodiment, the power section comprises a housing, a sleeve slidably disposed within the housing, and a piston slidably disposed within the sleeve and within the housing such that the fluid pressure within the power section causes the sleeve to oscillate relative to the housing and causes the piston to oscillate relative to the sleeve and the housing.

In another embodiment, the power section comprises a housing, a mandrel slidably disposed within the housing, said mandrel having an axially extending hole and a piston slidably associated within the axially extending hole such that when a fluid pressure is applied to the power section, the mandrel oscillates axially relative to the housing and the piston oscillates axially relative to the mandrel and the housing.

In either embodiment, the pump section has at least one intake valve and at least one exhaust valve. The housing has at least one fluid passageway in communication with the annular area around the exterior of the pump assembly.

In one embodiment of the pump section, an exhaust valve is disposed above an intake valve such that the exhaust valve oscillates with the power section and the intake valve is fixed relative to the housing such that fluid is drawn into the pump section through the fluid passageway and the intake valve and fluid is pumped into the interior of the pump section through the exhaust valve.

Alternatively, the exhaust valve may be disposed below the intake valve such that the intake valve oscillates with the power section and the exhaust valve is fixed relative to the housing such that fluid is drawn through the intake valve from the interior of the pump section and fluid is pumped out of the pump assembly through the exhaust valve and the fluid passageway.

In another embodiment, the pump section has first and second intake valves and first and second exhaust valves.

The housing defines a chamber and has first and second fluid passageways in communication with the annular area around the exterior of the pump assembly. The first and second intake valves respectively communicate with the first and second fluid passageways and the chamber. The first and second exhaust valves respectively communicate with the chamber and the interior of the pump section.

Alternatively, the first and second intake valves may respectively communicate with the interior of the pump section and the chamber. The first and second exhaust valves may respectively communicate with the chamber and the first and second fluid passageways.

BRIEF DESCRIPTION OF THE DRAWINGS

For a more complete understanding of the present invention, including its features and advantages, reference is now made to the detailed description of the invention, taken in conjunction with the accompanying drawings in which like numerals identify like parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the invention.

Figure 1:
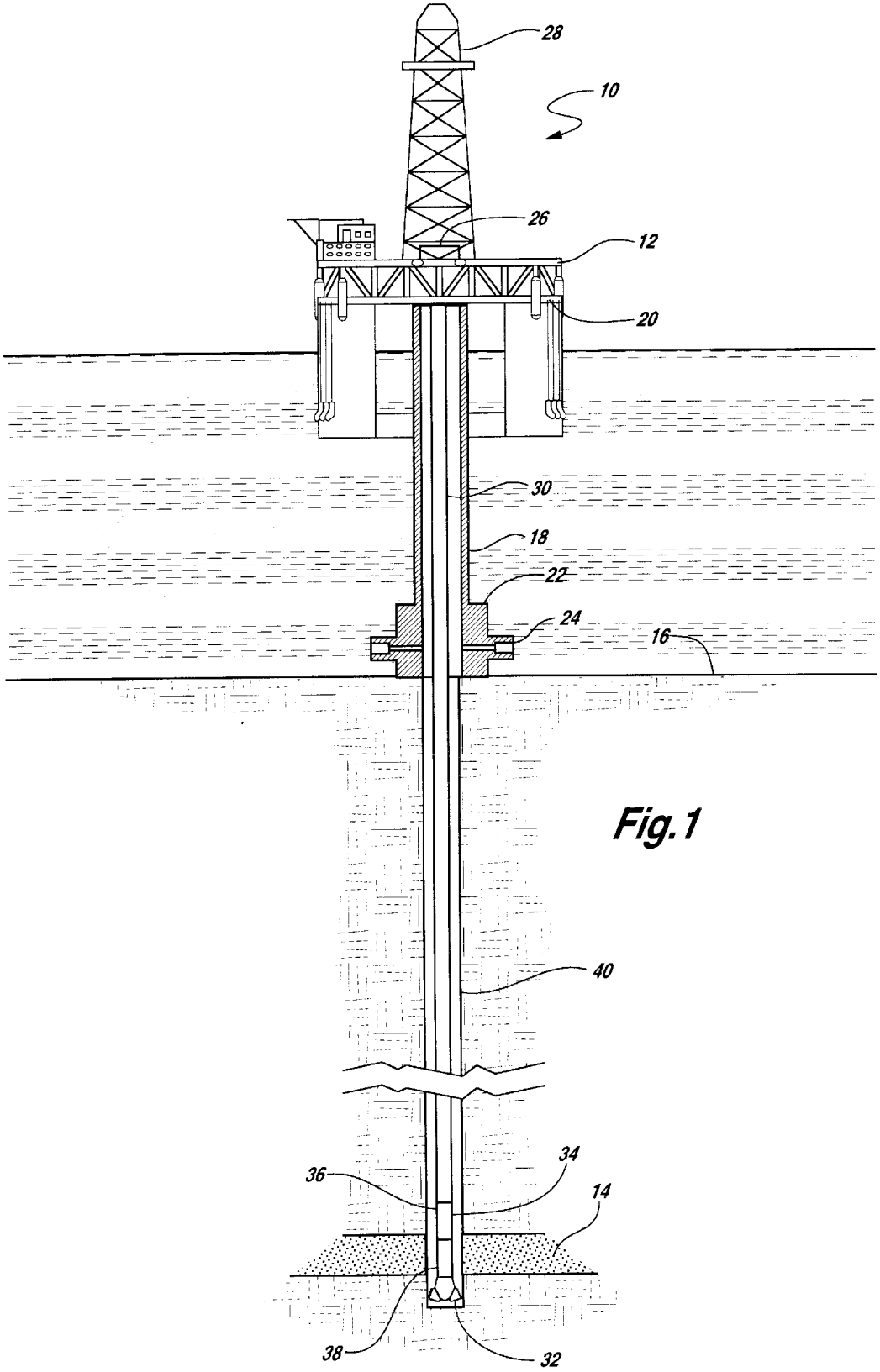
FIG. 1 is a schematic illustration of an offshore oil or gas drilling platform operating the automatic downhole pump assembly of the present invention.

Referring to FIG. 1, an automatic downhole pump assembly in use on an offshore oil or gas drilling platform is schematically illustrated and generally designated 10. A semisubmersible drilling platform 12 is centered over a submerged oil or gas formation 14 located below sea floor 16. A subsea conduit 18 extends from deck 20 of platform 12 to a well head installation 22 including blowout preventors 24. The platform 12 has a derrick 26 and a hoisting apparatus 28 for raising and lowering drill string 30 including drill bit 32 and tools to test the oil or gas formation 14 including automatic downhole pump assembly 34. Pump assembly 34 includes power section 36 and pump section 38.

During a drilling and testing operation, drill bit 32 is rotated on drill string 30 to create wellbore 40. Shortly after drill bit 32 intersects formation 14, drilling stops to allow formation testing before mud invasion or filter cake buildup occurs. The tubing pressure inside drill string 30 is then elevated, causing the internal mechanisms within power section 36 to oscillate. This oscillation operates the internal mechanisms within pump section 38 which, for example, may create a suction which draws down the pressure in formation 14. The suction allows for the quick cleanup of formation 14 so that a representative sample of the formation fluid can be obtained with a minimum amount of drilling downtime. After sampling of the formation, the tubing pressure is reduced causing automatic downhole pump assembly 34 to stop pumping and allowing drilling to resume.

It should be understood by one skilled in the art, that pump assembly 34 of the present invention is not limited to is use in drill string 30 as shown in FIG. 1. For example, pump section 38 of pump assembly 34 may be inserted into drill string 30 on a probe having a profile which locks into drill string 30 near drill bit 32. In fact, pump assembly 34 of the present invention may be employed entirely on a probe that is inserted into drill string 30. In addition, pump assembly 34 may be used during other well service operations. For example, pump assembly 34 may be used to automatically pump fluid from the tubing into formation 14 or into fluid ports within drill string 30 to operate other downhole tools.

It should also be understood by one skilled in the art that pump assembly 34 of the present invention is not limited to use with semisubmersible drilling platform 12 as shown in FIG. 1. Pump assembly 34 is equally well-suited for use with conventional offshore drilling rigs or during onshore drilling operations.

Figure 2A:
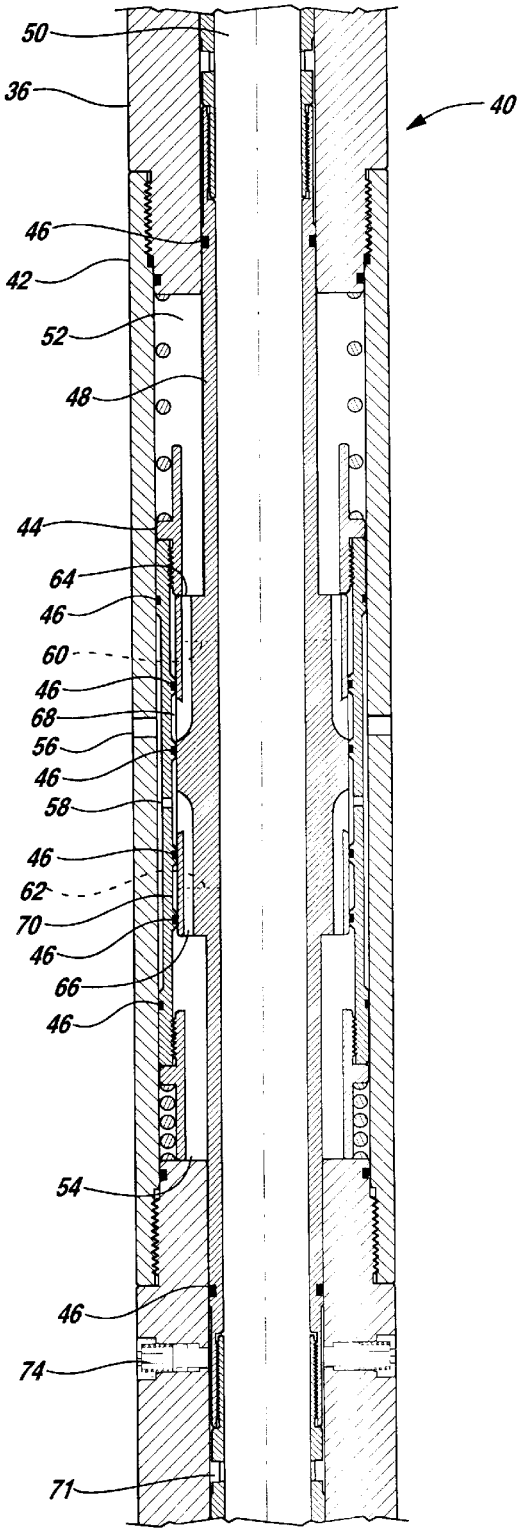
FIGS. 2A–2B are half-sectional views of an automatic downhole pump assembly of the present invention.
Figure 2B:
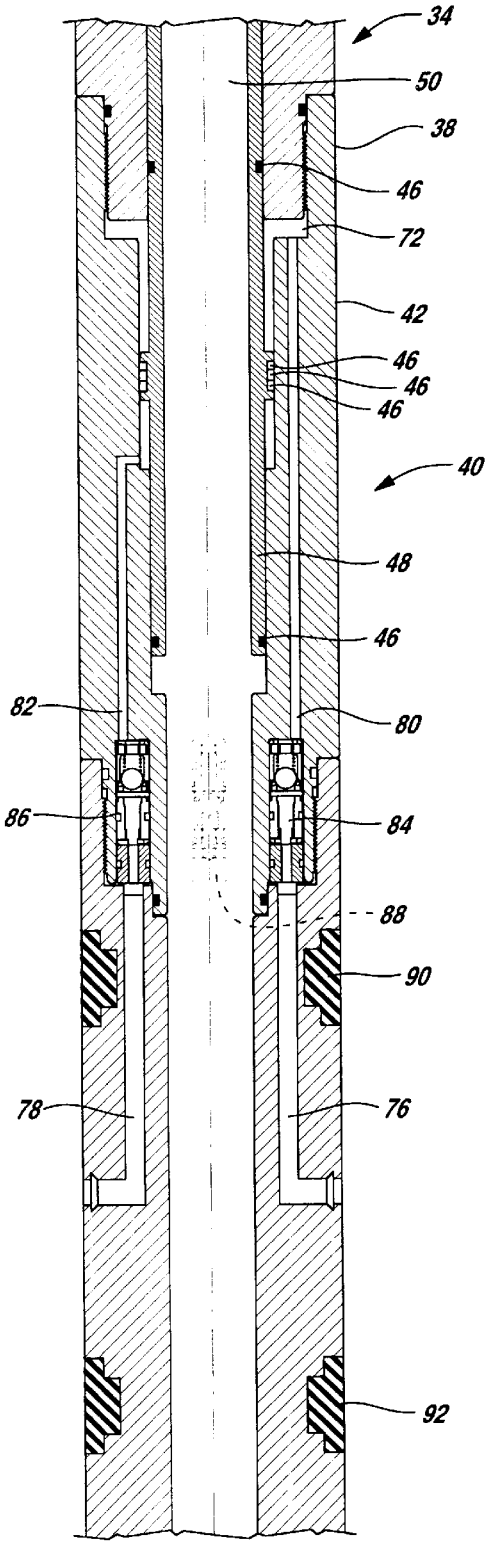

Referring to FIGS. 2A–2B, power section 36 and pump section 38 of automatic downhole pump assembly 34 are depicted. Power section 36 comprises a housing 42 which may be threadably connected to drill string 30 at its upper and lower ends. Sleeve 44 is slidably disposed within housing 42. Annular seals 46, such as O-rings, are disposed between sleeve 44 and housing 42 to provide a seal therebetween. Piston 48 is slidably disposed within sleeve 44 and within housing 42. Annular seals 46 are disposed between piston 48 and sleeve 44 to provide a seal therebetween. Annular seals 46 are also disposed between piston 48 and housing 42 to provide a seal therebetween. Piston 48 defines an interior volume 50 which includes the centerline of drill string 30.

Between housing 42 and piston 48 is upper chamber 52 and lower chamber 54. Housing 42 defines fluid passageway 56 which is in communication with wellbore 40. Sleeve 44 defines fluid passageway 58 which is in communication with fluid passageway 56 of housing 42. Piston 48 defines upper radial fluid passageway 60 and lower radial fluid passageway 62. Upper radial fluid passageway 60 and lower radial fluid passageway 62 are in communication with interior volume 50. Piston 48 also defines upper axial fluid passageway 64 which is in communication with upper chamber 52 and lower axial fluid passageway 66 which is in communication with lower chamber 54. Between piston 48 and sleeve 44 is upper volume 68 and lower volume 70.

In operation, upper radial fluid passageway 60 is alternately in communication with upper chamber 52 and upper volume 68. Upper axial fluid passageway 64 is alternately in communication with upper volume 68 and fluid passageway 58 of sleeve 44. Lower radial fluid passageway 62 is alternately in communication with lower chamber 54 and lower volume 70. Lower axial fluid passageway 66 is alternately in communication with lower volume 70 and fluid passageway 58 of sleeve 44 as piston 48 oscillates with respect to housing 42.

Piston 48 defines a groove 71 which accepts a plurality of locking members 74 which prevent relative axial movement between piston 48 and housing 42 when the tubing pressure inside interior volume 50 is less than a predetermined value, such as during drilling. In operation, when the tubing pressure inside interior volume 50 exceeds the annulus pressure by a predetermined value, the bias force of the springs within locking members 74 is overcome, allowing locking members 74 to retract, thereby allowing piston 48 to move axially relative to housing 42.

Piston 48 and housing 42 further define chamber 72. Housing 42 defines formation fluid passageways 76, 78 and fluid passageways 80, 82. Disposed within housing 42 and between formation fluid passageway 76 and fluid passageway 80 is intake valve 84. Disposed within housing 42 and between formation fluid passageway 78 and fluid passageway 82 is intake valve 86. Disposed within housing 42 is exhaust valve 88 which is in communication with chamber 72. Also disposed within housing 44 is a second exhaust valve (not pictured) also in communication with chamber 72.

In operation, packer 90 and packer 92 are expanded to seal the area between wellbore 40 and housing 42 such that formation 14 is isolated from the rest of wellbore 40. The tubing pressure in interior volume 50 is increased causing piston 48 and sleeve 44 to oscillate axially relative to housing 42. As piston 48 travels downwardly, formation fluid enters formation fluid passageway 76, travels through intake valve 84 into fluid passageway 80 and chamber 72. Formation fluid in chamber 72 exits through exhaust valve 88 into interior volume 50 and into a retrievable sampler (not pictured). Similarly, as piston 48 travels upwardly, formation fluid enters formation fluid passageway 78 and travels through intake valve 86, fluid passageway 82 and chamber 72. Formation fluids exit chamber 72 through an exhaust valve (not pictured) into interior volume 50.

Figures 3A, 3B, 3C, 3D, 3E:
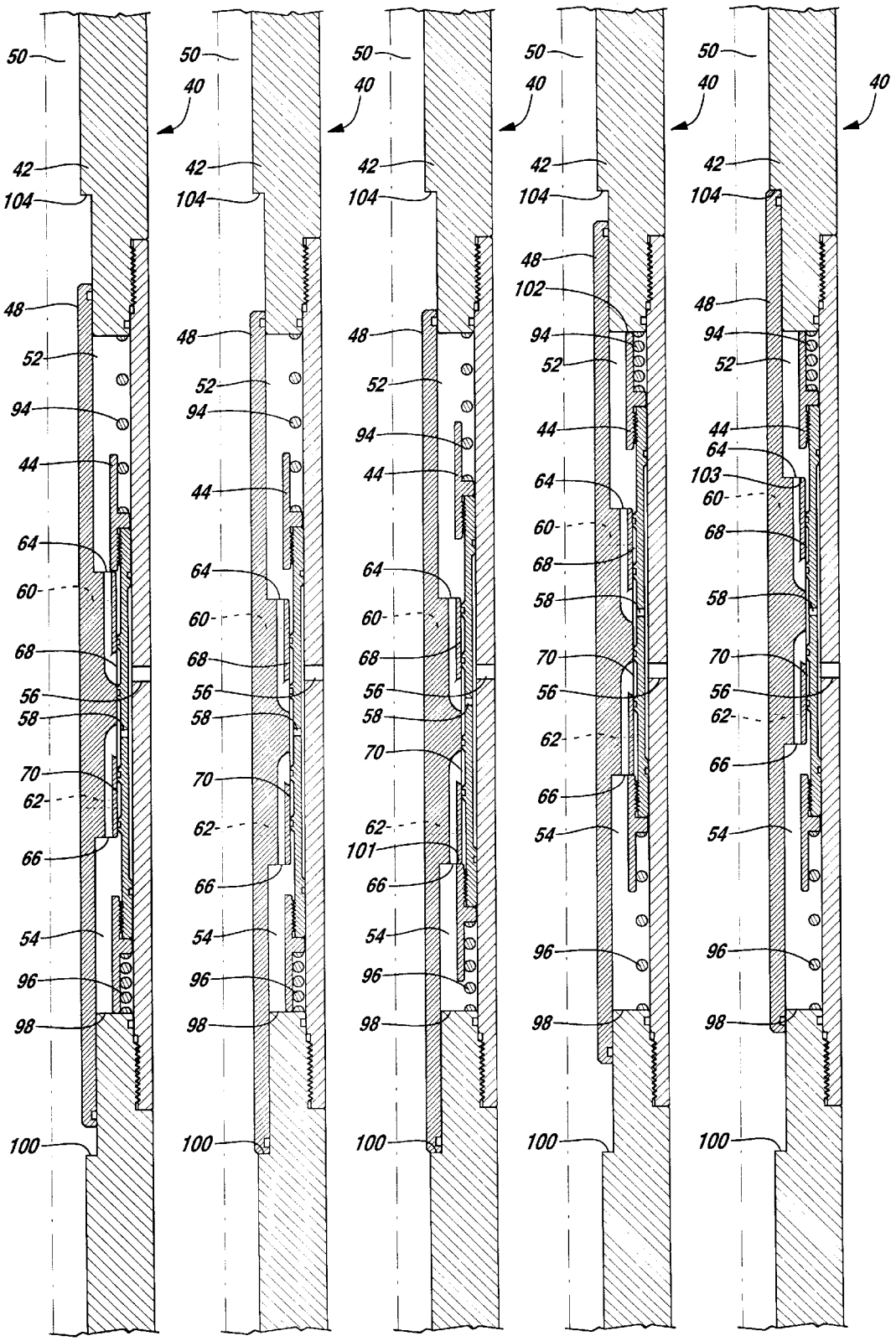
FIGS. 3A–3E are quarter-sectional views of the operation of a power section of an automatic downhole pump assembly of the present invention.

In FIGS. 3A–3E, the operation of power section 36 of automatic downhole pump assembly 34 is depicted. Fluid from interior volume 50 enters upper chamber 52 through upper radial fluid passageway 60. Fluid from lower chamber 54 enters wellbore 40 through lower axial fluid passageway 66, fluid passageway 58 of sleeve 44, and fluid passageway 56 of housing 42. The high pressure fluid in chamber 52 downwardly urges sleeve 44 and piston 48 relative to housing 42. Upper coil spring 94 further urges sleeve 44 downward relative to housing 42. Sleeve 44 travels downward until it contacts shoulder 98 of housing 42 as depicted in FIG. 3A.

The high pressure in chamber 52 continues to urge piston 48 downward relative to housing 42 and sleeve 44 after sleeve 44 contacts shoulder 98. Piston 48 continues to travel downward relative to sleeve 44 until radial fluid passageway 60 is in communication with upper volume 68, upper axial fluid passageway 64 is in communication with fluid passageway 58 of sleeve 44, lower radial fluid passageway 62 is in communication with lower chamber 54, and lower axial fluid passageway 66 is in communication with lower volume 70 completing the downward stroke of piston 48, equalizing the pressure in upper chamber 52 and lower chamber 54 and removing all hydraulic force on sleeve 44 as depicted in FIG. 3B.

Lower coil spring 96 upwardly urges sleeve 44 until sleeve 44 contacts shoulder 101 of piston 48 as depicted in FIG. 3C. High pressure fluid from interior volume 50 enters lower chamber 54 through lower radial fluid passageway 62 while fluid from upper chamber 52 enters wellbore 40 through upper axial fluid passageway 64, fluid passageway 58 of sleeve 44, and fluid passageway 56 of housing 42. The high pressure fluid in chamber 54 upwardly urges sleeve 44 and piston 48 relative to housing 42. Piston 48 and sleeve 44 travel upward together until sleeve 44 stops against shoulder 102 of housing 42 as depicted in FIG. 3D.

The high pressure fluid in lower chamber 54 continues to urge piston 48 upward until upper radial fluid passageway 60 is in communication with upper chamber 54, upper axial fluid passageway 64 is in communication with upper volume 68, lower radial fluid passageway 62 is in communication with lower volume 70 and lower axial fluid passageway 66 is in communication with fluid passageway 58 of sleeve 44. This ends the upward stroke of piston 48 and allows the pressure in upper chamber 52 and lower chamber 54 to equalize and removes all hydraulic forces on sleeve 44, as depicted in FIG. 3E. Upper coil spring 94 downwardly urges sleeve 44 until sleeve 44 contacts shoulder 103, allowing fluid from interior volume 50 to enter upper chamber 52 and starting the downward cycle again.

Figure 4A:
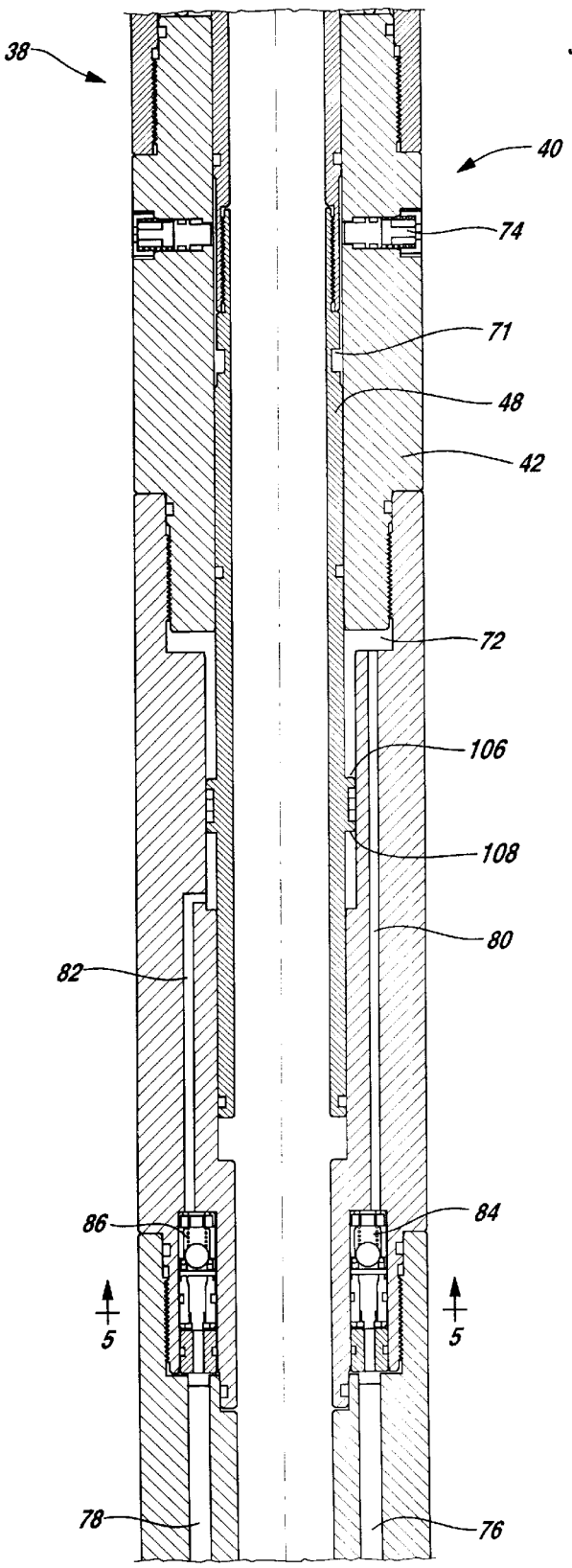
FIG. 4 is a half-sectional view of a pump section of an automatic downhole pump of the present invention.
Figure 4B:
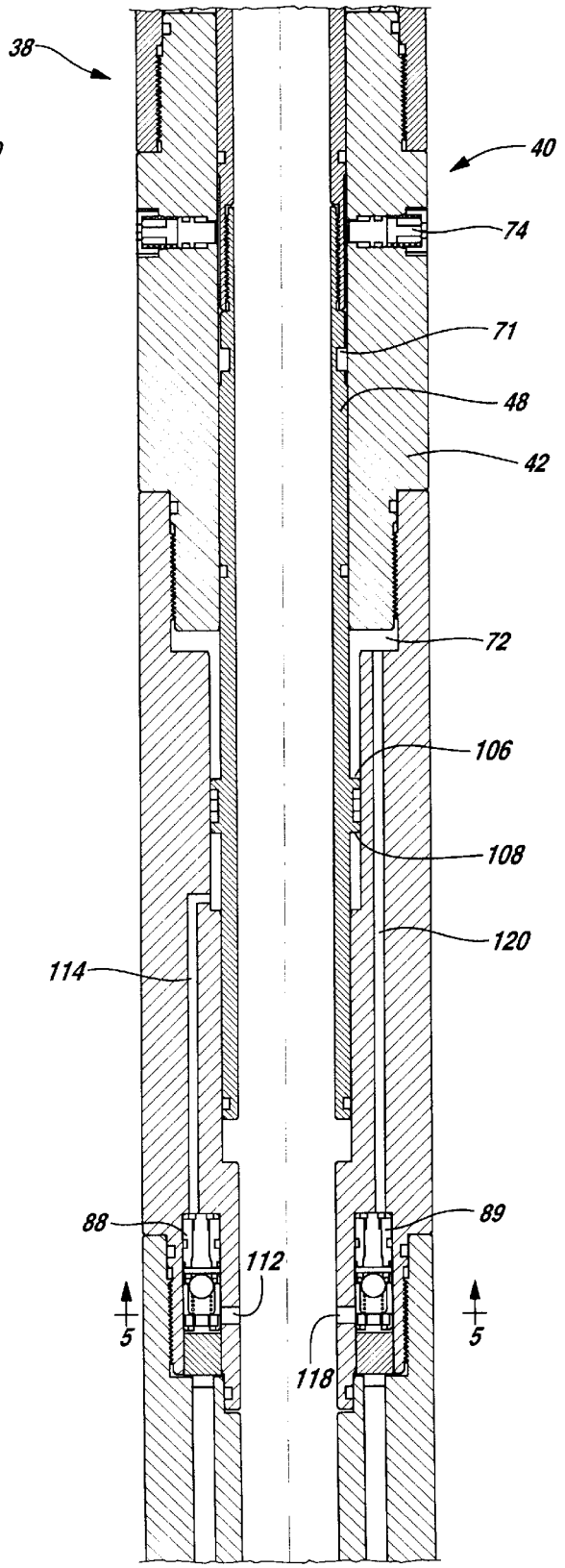
Figure 5:
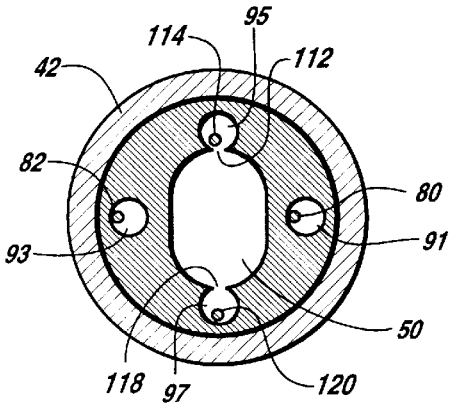
FIG. 5 is a cross-sectional view of the pump section in FIG. 4 taken along line 5—5.

Referring next to FIGS. 4A, 4B and 5, pump section 38 of automatic downhole pump assembly 34 is depicted. As piston 48 oscillates axially within housing 42, formation fluid is pumped through intake valve 84, intake valve 86, exhaust valve 88 and exhaust valve 89 which are respectively disposed within bores 91, 93, 95, and 97 of housing 42. When piston 48 is traveling upward relative to housing 42, formation fluid enters formation fluid passageway 78, travels through intake valve 86 and fluid passageway 82 into the bottom of chamber 72 and against shoulder 108 of piston 48. Fluid in chamber 72 above shoulder 106 of piston 48 enters interior volume 50 through fluid passageway 114 exhaust valve 88 and fluid passageway 112.

As piston 48 travels downward relative to housing 42, formation fluid enters formation fluid passageway 76, travels through intake valve 84 and fluid passageway 80 into the upper part of chamber 72. Fluid in chamber 72 travels into interior volume 50 through fluid passageway 120, exhaust valve 89 and fluid passageway 118. Fluid entering interior volume 50 may be captured in a cylinder for sampling purposes.

In an alternate embodiment, valves 84, 86, 88 and 89 may be inverted such that fluid from interior volume 50 may be pumped out of pump section 38 into formation 14, into another section of downhole pump assembly 34 or into another downhole tool. In this embodiment, fluid from interior volume 50 enters the upper part of chamber 72 through fluid passageway 120, valve 89 and fluid passageway 118 as piston 48 is traveling downward relative to housing 42. Fluid in chamber 72 passes through fluid passageway 82, valve 86 and fluid passageway 78 before exiting pump section 38.

As piston 48 travels upward relative to housing 42, fluid from interior volume 50 enters chamber 72 through fluid passageway 112, valve 88 and fluid passageway 114. Fluid in chamber 72 travels out of pump section 38 through fluid passageway 80, valve 84 and fluid passageway 76.

Figure 6:
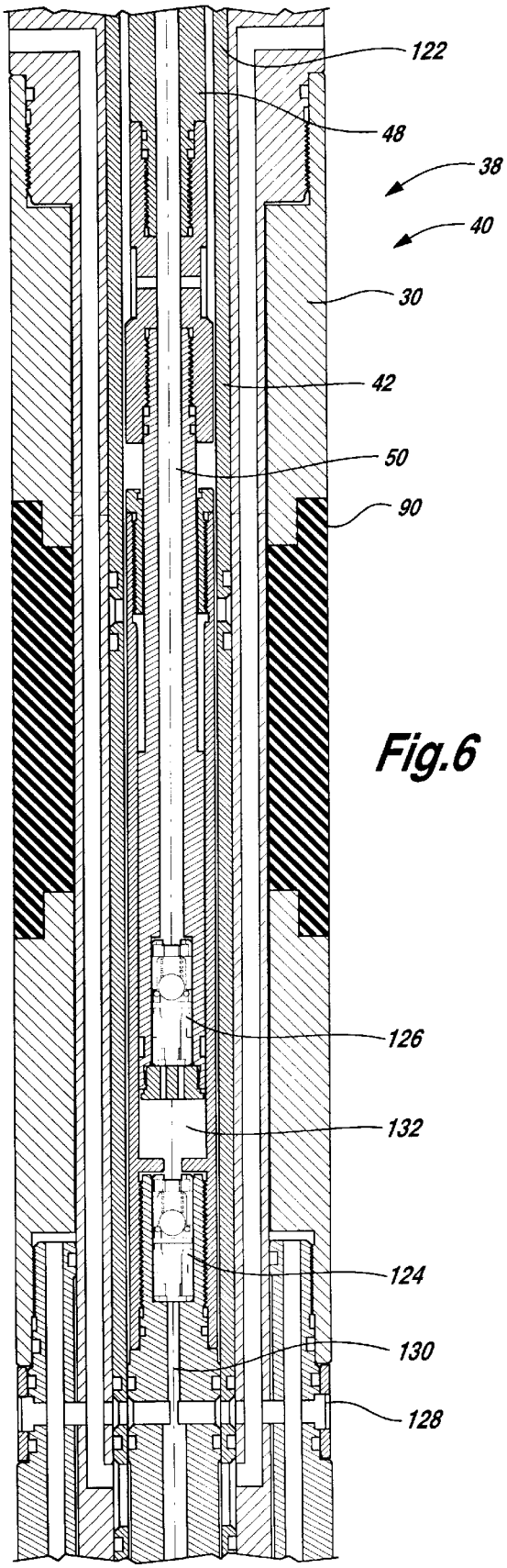
FIG. 6 is a half-sectional view of a pump section of an automatic downhole pump assembly of the present invention.

In FIG. 6, an alternate embodiment of pump section 38 is depicted. Pump section 38 is inserted into drill string 30 on probe 122 which comprises housing 42, piston 48, intake valve 124 and exhaust valve 126. As piston 48 travels upward, formation fluids enter inlet port 128 and travel through fluid passageway 130 and inlet valve 124 which is stationary with respect to housing 42. Formation fluids then enter chamber 132. As piston 48 travels downward relative to housing 42, exhaust valve 126 travels toward intake valve 124 causing formation fluids in chamber 132 to travel through exhaust valve 126 into interior volume 50. In this embodiment, valves 124 and 126 may be inverted such that as piston 48 travels upward, fluid from interior volume 50 passes through valve 26 into chamber 132. As piston 48 travels downward, fluid from chamber 132 is forced through valve 124 into fluid passageway 130, port 128 and formation 14. In this configuration, pump section 38 may also pump fluid into other sections of downhole pump assembly 34 or into other downhole tools. This embodiment of pump section 38 may be used in conjunction with a power section 36 which is integral with drill string 30 as described in reference to FIG. 2A or a probe mounted power section 36 as described in reference to FIG. 7.

Figure 7A:
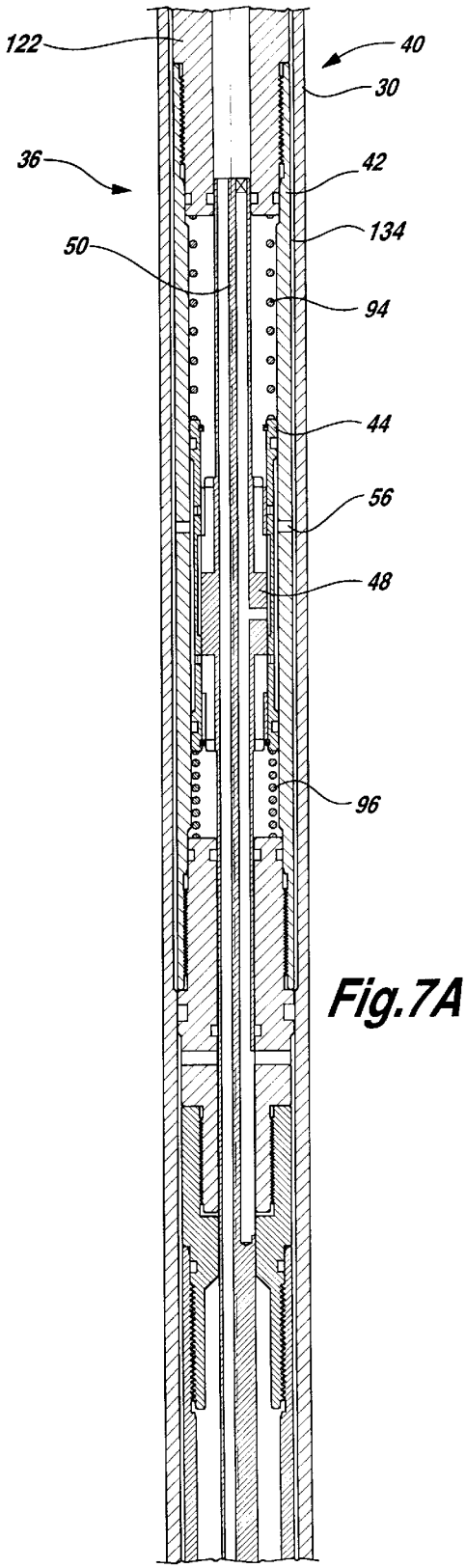
FIG. 7 is a half-sectional view of an automatic downhole pump assembly of the present invention.
Figure 7B:
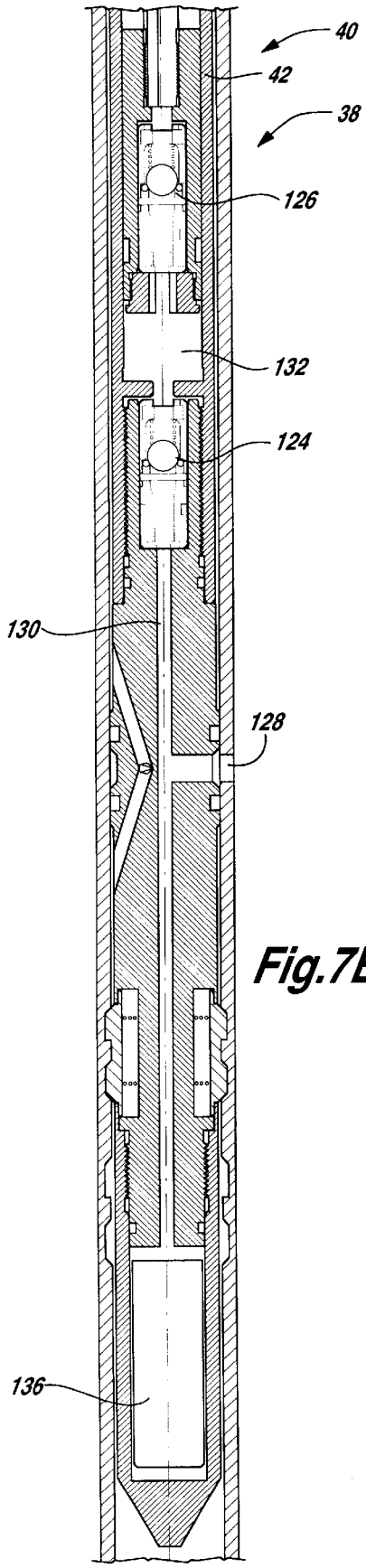

Referring to FIG. 7, a probe 122 mounted embodiment of automatic downhole pump assembly 34 is depicted. Power section 36 includes housing 42, sleeve 44 slidably disposed within housing 42 and piston 48 slidably disposed within sleeve 44 and housing 42. Between pipe string 30 and housing 42 is annular chamber 134 which is in communication with fluid passageway 56 of housing 42. Annular chamber 134 provides an outlet for the fluid pumped into interior volume 50 during operation of power section 36.

Pump section 38 includes housing 42, piston 48, intake valve 124 and exhaust valve 126. As piston 48 travels upward, formation fluids enter inlet port 128 and travel through fluid passageway 130 and inlet valve 124 filling chamber 132. As piston 48 travels downward relative to housing 42, exhaust valve 126 travels toward intake valve 124 causing formation fluids in chamber 132 to travel through exhaust valve 126. The pressure of formation fluids entering inlet port 128 is measured by pressure recorder 136.

Figure 8:
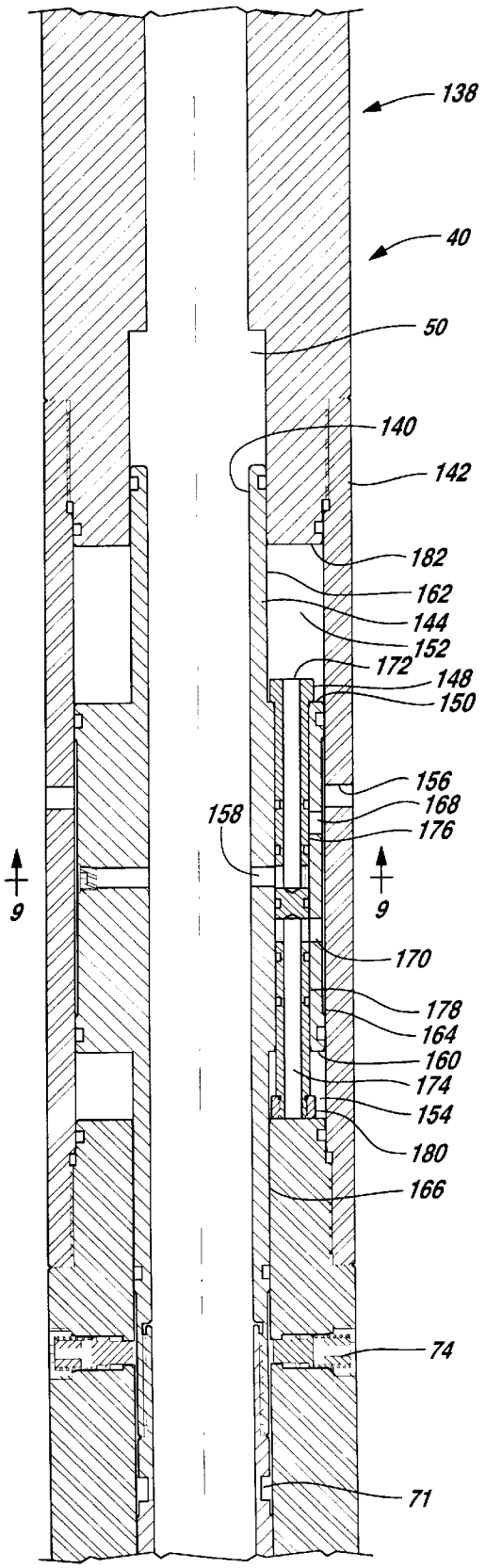
FIG. 8 is a half-sectional view of a power section of an automatic downhole pump assembly of the present invention.
Figure 9:
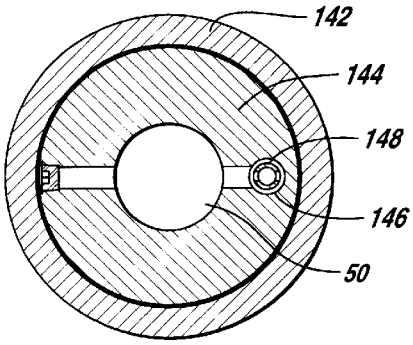
FIG. 9 is a cross-sectional view of the power section in FIG. 8 taken along line 9—9.

Referring next to FIGS. 8 and 9, an alternate embodiment of power section 138 of automatic downhole pump assembly 34 is depicted. Power section 138 comprising housing 142 and mandrel 144 slidably disposed within housing 142, said mandrel 144 having inner cylindrical surface 140 defining interior volume 50. Mandrel 144 also defines hole 146 which extends between upper annular radially extending shoulder 150 and lower annual radially extending shoulder 160. Mandrel 144 has upper outer cylindrical surface 162 extending above shoulder 150, central outer cylindrical surface 164 extending between shoulder 150 and shoulder 160, and lower outer cylindrical surface 166 extending below shoulder 160. Between housing 142, shoulder 150 and surface 162 is upper chamber 152. Between housing 142, shoulder 160 and surface 166 is lower chamber 154.

Housing 142 defines fluid passageway 156 which is in communication with wellbore 40. Mandrel 144 defines fluid passageway 158 which is in communication with interior volume 50. Mandrel 144 also has upper fluid passageway 168 and lower fluid passageway 170 in communication with fluid passageway 156 of housing 142. Between piston 148 and mandrel 144 is upper volume 176 and lower volume 178.

In operation, upper fluid passageway 168 of mandrel 144 is alternately in communication with upper volume 176 and upper fluid passageway 172 of piston 148. Lower fluid passageway 170 of mandrel 144 is alternately in communication with lower volume 178 and lower fluid passageway 174 of piston 148. Fluid passageway 158 of mandrel 144 is alternately in communication with upper fluid passageway 172 and lower fluid passageway 174 of piston 148 as mandrel 144 oscillates relative to housing 142.

On the downward stroke of piston 148 and mandrel 144, high pressure fluid from interior volume 50 enters upper chamber 152 through fluid passageway 158 of mandrel 144 and upper fluid passageway 172 of piston 148 and fluid from lower chamber 154 exits into wellbore 40 through passageway 156 of housing 142, lower fluid passageway 170 of mandrel 144 and lower fluid passageway 174 of piston 148. Piston 148 travels downward until contact is made between piston 148 and shoulder 180 of housing 142. Mandrel 144 continues to travel downward until fluid passageway 158 of mandrel 144 is in communication with lower fluid passageway 174 of piston 148, upper fluid passageway 168 of mandrel 144 is in communication with upper fluid passageway 172 of piston 148 and lower fluid passageway 170 of mandrel 144 is in communication with lower volume 178.

On the upward stroke of piston 148 and mandrel 144, high pressure fluid from interior volume 150 enters lower chamber 154 through fluid passageway 158 of mandrel 144 and lower fluid passageway 174 of piston 148. While fluid from upper chamber 152 enters wellbore 40 through upper fluid passageway 172 of piston 148 and upper fluid passageway 168 of mandrel 144. Piston 148 travels upward until contact is made between piston 148 and shoulder 182 of housing 142. Mandrel 144 continues to travel upward until fluid passageway 158 of mandrel 144 is in communication with upper fluid passageway 172 of piston 148, upper fluid passageway 168 of mandrel 144 is in communication with upper volume 176 and lower fluid passageway 170 of mandrel 144 is in communication with lower fluid passageway 174 of piston 148. In addition, upper and lower coil springs (not pictured) may downwardly and upwardly bias piston 148, respectively.

Therefore, the automatic downhole pump assembly and method for use of the same disclosed herein has inherent advantages over the prior art. While certain embodiments of the invention have been illustrated for the purposes of this disclosure, numerous changes in the arrangement and construction of the parts may be made by those skilled in the art, such changes being embodied within the scope and spirit of the present invention as defined by the appended claims.

What is claimed is:

1. An automatic downhole pump assembly comprising:

a power section including a housing, a sleeve slidably disposed within said housing and a piston defining an interior volume, said piston slidably disposed within said sleeve and within said housing such that when a fluid pressure is applied to said interior volume said sleeve oscillates relative to said housing and said piston oscillates relative to said sleeve and said housing; and a pump section operably associated with said power section so that said pump section is operated upon oscillatory motion of said piston after application of said fluid pressure to said interior volume.

2. The automatic downhole pump assembly as recited in claim 1 wherein said sleeve oscillates axially relative to said housing.

3. The automatic downhole pump assembly as recited in claim 1 wherein said sleeve oscillates rotatably relative to said housing.

4. The automatic downhole pump assembly as recited in claim 1 wherein said piston oscillates axially relative to said sleeve and said housing.

5. The automatic downhole pump assembly as recited in claim 1 wherein said piston oscillates rotatably relative to said sleeve and said housing.

6. The automatic downhole pump assembly as recited in claim 1 wherein said piston and said housing define an upper chamber and a lower chamber therebetween.

7. The automatic downhole pump assembly as recited in claim 6 wherein said housing has at least one fluid passageway in communication with an annular volume around the exterior of said housing, said sleeve has at least one fluid passageway which is in communication with said at least one fluid passageway of said housing and said piston has at least one upper radial fluid passageway in communication with said interior volume, at least one upper axial fluid passageway in communication with said upper chamber, at least one lower radial fluid passageway in communication with said interior volume, and at least one lower axial fluid passageway in communication with said lower chamber.

8. The automatic downhole pump assembly as recited in claim 7 wherein said piston and said sleeve define an upper volume and a lower volume therebetween.

9. The automatic downhole pump assembly as recited in claim 8 wherein said at least one upper radial fluid passageway is alternately in communication with said upper chamber and said upper volume, wherein said at least one upper axial fluid passageway is alternately in communication with said upper volume and said at least one fluid passageway of said sleeve, wherein said at least one lower radial fluid passageway is alternately in communication with said lower chamber and said lower volume, and wherein said at least one lower axial fluid passageway is alternately in communication with said lower volume and said at least one fluid passageway of said sleeve as said piston oscillates.

10. The automatic downhole pump assembly as recited in claim 8 wherein fluid from said interior volume enters said upper chamber through said at least one upper radial fluid passageway and fluid from said lower chamber enters said annual volume through said at least one lower axial fluid passageway, said at least one fluid passageway of said sleeve, and said at least one fluid passageway of said housing, thereby urging said sleeve and said piston in a first direction relative to said housing.

11. The automatic downhole pump assembly as recited in claim 8 wherein fluid from said interior volume enters said upper chamber through said at least one upper radial fluid passageway and fluid from said lower chamber enters said annular volume through said at least one lower axial fluid passageway, said at least one fluid passageway of said sleeve, and said at least one fluid passageway of said housing, thereby urging said piston in a first direction relative to said sleeve and said housing and placing said at least one upper radial fluid passageway in communication with said upper volume, said at least one upper axial fluid passageway in communication with at least one fluid passageway of said sleeve, said at least one lower radial fluid passageway in communication with said lower chamber, and said at least one lower axial fluid passageway in communication with said lower volume.

12. The automatic downhole pump assembly as recited in claim 8 wherein fluid from said interior volume enters said lower chamber through said at least one lower radial fluid passageway and fluid from said upper chamber enters said annular volume through said at least one upper axial fluid passageway, said at least one fluid passageway of said sleeve, and said at least one fluid passageway of said housing, thereby upwardly urging said sleeve and said piston in a first direction relative to said housing.

13. The automatic downhole pump assembly as recited in claim 8 wherein fluid from said interior volume enters said lower chamber through said at least one lower radial fluid passageway and fluid from said upper chamber enters said annular volume through said at least one upper axial fluid passageway, said at least one fluid passageway of said sleeve, and said at least one fluid passageway of said housing, thereby urging said piston in a first direction relative to said sleeve and said housing and placing said at least one upper radial fluid passageway in communication with said upper chamber, said at least one upper axial fluid passageway in communication with said upper volume, said at least one lower radial fluid passageway in communication with said lower volume, and said at least one lower axial fluid passageway in communication with said at least one fluid passageway of said sleeve.

14. The automatic downhole pump assembly as recited in claim 1 further comprising an upper coil spring concentrically disposed within said housing biasing said sleeve in a first direction and a lower coil spring concentrically disposed within said housing biasing said sleeve in a second direction.

15. The automatic downhole pump assembly as recited in claim 1 wherein said pump section further includes at least one intake valve and at least one exhaust valve and wherein said housing has at least one fluid passageway in communication with an annular volume around the exterior of said housing.

16. The automatic downhole pump assembly as recited in claim 15 wherein said at least one intake valve and said at least one exhaust valve are check valves.

17. The automatic downhole pump assembly as recited in claim 15 wherein said at least one exhaust valve oscillates with said piston and said at least one intake valve is fixed relative to said housing and is in communication with said at least one fluid passageway, thereby drawing fluid into said pump assembly through said at least one fluid passageway and said intake valve when said piston moves in a first direction and forcing said fluid through said exhaust valve when said piston moves in a second direction.

18. The automatic downhole pump assembly as recited in claim 15 wherein said at least one intake valve oscillates with said piston and said at least one exhaust valve is fixed relative to said housing and is in communication with said at least one fluid passageway such that fluid exits said pump assembly through said at least one fluid passageway when said piston moves in a first direction and fluid passes through said intake valve when said piston moves in a second direction.

19. The automatic downhole pump assembly as recited in claim 1 wherein said piston and housing define a chamber therebetween, wherein said housing has first and second fluid passageways in communication with an annular volume around the exterior of said housing, and wherein said pump section further includes first and second intake valves and first and second exhaust valves, said first and second intake valves respectively in communication with said first and second fluid passageways and said chamber, said first and second exhaust valves in communication with said chamber and said interior volume.

20. The automatic downhole pump assembly as recited in claim 19 wherein fluid enters said chamber through said first intake valve and fluid exits said chamber to said interior volume through said second exhaust valve as said piston travels in a first direction and wherein fluid enters said chamber through said second intake valve and fluid exits said chamber to said interior volume through said first exhaust valve as said piston travels in a second direction.

21. The automatic downhole pump assembly as recited in claim 1 wherein said piston and housing define a chamber therebetween, wherein said housing has first and second fluid passageways in communication with an annular volume around the exterior of said housing, and wherein said pump section further includes first and second intake valves and first and second exhaust valves, said first and second exhaust valves respectively in communication with said first and second fluid passageways and said chamber, said first and second intake valves in communication with said chamber and said interior volume.

22. The automatic downhole pump assembly as recited in claim 21 wherein fluid enters said chamber from said interior volume through said first intake valve and fluid exits said chamber through said second exhaust valve and said second fluid passageway as said piston travels in a first direction, and wherein fluid enters said chamber from said interior volume through said second intake valve and fluid exits said chamber through said first exhaust valve and said first fluid passageway as said piston travels in a second direction.

23. An automatic downhole pump assembly comprising:

a housing;

a mandrel slidably disposed within said housing defining an interior volume, said mandrel having at least one axially extending hole;

at least one piston slidably associated within said at least one axially extending hole such that when a fluid pressure is applied to said interior volume, said mandrel oscillates axially relative to said housing and said piston oscillates axially relative to said mandrel and said housing; and a pump section operably associated with said mandrel.

24. The automatic downhole pump assembly as recited in claim 23 wherein said mandrel has upper and lower annular radially extending shoulders and an upper outer cylindrical surface extending axially upward from said upper annular radially extending shoulder, a central outer cylindrical surface axially extending between said upper annular radially extending shoulder and said lower annular radially extending shoulder and a lower outer cylindrical surface extending axially downward from said lower annular radially extending shoulder.

25. The automatic downhole pump assembly as recited in claim 24 wherein said upper annular radially extending shoulder, said upper outer cylindrical surface of said mandrel and said housing define an upper chamber and wherein said lower annular radially extending shoulder, said lower outer cylindrical surface of said mandrel and said housing define a lower chamber.

26. The automatic downhole pump assembly as recited in claim 25 wherein said at least one axially extending hole extends between said upper and lower annular radially extending shoulders.

27. The automatic downhole pump assembly as recited in claim 26 wherein said housing has at least one fluid passageway in communication with an annular volume around the exterior of said housing, said mandrel has at least one inner fluid passageway which is in communication with said interior volume, said mandrel has at least one upper and lower outer fluid passageway in communication with said at least one fluid passageway of said housing and said piston has an upper fluid passageway in communication with said upper chamber and a lower fluid passageway in communication with said lower chamber.

28. The automatic downhole pump assembly as recited in claim 27 wherein said piston and said mandrel define an upper volume and a lower volume therebetween.

29. The automatic downhole pump assembly as recited in claim 28 wherein said at least one upper outer fluid passageway of said mandrel is alternately in communication with said upper volume and said upper fluid passageway of said piston, wherein said at least one lower outer fluid passageway of said mandrel is alternately in communication with said lower volume and said lower fluid passageway of said piston and wherein said inner fluid passageway of said mandrel is alternately in communication with said upper fluid passageway and said lower fluid passageway of said piston as said mandrel oscillates.

30. The automatic downhole pump assembly as recited in claim 28 wherein fluid from said interior volume enters said upper chamber through said at least one inner fluid passageway of said mandrel and said upper fluid passageway of said piston and fluid from said lower chamber enters said annular volume through lower fluid passageway of said piston and said at least one lower outer fluid passageway of said mandrel, thereby urging said mandrel and said piston in a first direction relative to said housing.

31. The automatic downhole pump assembly as recited in claim 28 wherein fluid from said interior volume enters said upper chamber through said at least one inner fluid passageway of said mandrel and said upper fluid passageway of said piston and fluid from said lower chamber enters said annular volume through said lower fluid passageway of said piston and said at least one lower outer fluid passageway of said mandrel, thereby urging said mandrel in a first direction relative to said piston and said housing and placing said at least one inner fluid passageway of said mandrel in communication with said lower fluid passageway of said piston, said at least one upper outer fluid passageway of said mandrel in communication with said upper fluid passageway of said piston, and said at least one lower outer fluid passageway of said mandrel in communication with said lower volume.

32. The automatic downhole pump assembly as recited in claim 28 wherein fluid from said interior volume enters said lower chamber through said at least one inner fluid passageway of said mandrel and said lower fluid passageway of said piston and fluid from said upper chamber enters said annular volume through upper fluid passageway of said piston and said at least one upper outer fluid passageway of said mandrel, thereby urging said mandrel and said piston in a first direction relative to said housing.

33. The automatic downhole pump assembly as recited in claim 28 wherein fluid from said interior volume enters said lower chamber through said at least one inner fluid passageway of said mandrel and said lower fluid passageway of said piston and fluid from said upper chamber enters said annular volume through upper fluid passageway of said piston and said at least one upper outer fluid passageway of said mandrel, thereby urging said mandrel in a first direction relative to said piston and said housing and placing said at least one inner fluid passageway of said mandrel in communication with said upper fluid passageway of said piston, said at least one upper outer fluid passageway of said mandrel in communication with said upper volume, and said at least one lower outer fluid passageway of said mandrel in communication with said lower fluid passageway of said piston.

34. The automatic downhole pump assembly as recited in claim 23 further comprising an upper coil spring biasing said mandrel in a first direction and a lower coil spring biasing said mandrel in a second direction.

35. The automatic downhole pump assembly as recited in claim 23 wherein said pump further includes at least one intake valve and at least one exhaust valve.

36. The automatic downhole pump assembly as recited in claim 23 wherein said pump further includes first and second intake valves and first and second exhaust valves.

37. A method of operating a automatic downhole pump assembly comprising the steps of:

connecting the pump assembly within a drill string above a drill bit, the pump assembly having a power section and a pump section operably associated with said power section;

drilling at least a portion of a wellbore such that the pump assembly is disposed with the wellbore:

applying a fluid pressure to said power section;

oscillating said power section; and operating said pump section as said power section oscillates.

38. The method as recited in claim 37 further including the step of inflating a pair of straddle packers above and below a formation.

39. The method as recited in claim 38 further including the steps of deflating said straddle packers and drilling said wellbore.

40. The method as recited in claim 37 further including the steps of pumping fluid through the pump assembly.

41. The method as recited in claim 40 further including the steps of pumping fluid into the pump assembly.

42. The method as recited in claim 40 further including the steps of pumping fluid out of the pump assembly.

* * * * *